US010034504B2

(12) United States Patent
Boyle

(10) Patent No.: US 10,034,504 B2
(45) Date of Patent: Jul. 31, 2018

(54) REAR POCKET FOR PANTS, PANTS INCLUDING SAME, AND RELATED METHODS

(71) Applicant: Alf Wear, Salt Lake City, UT (US)

(72) Inventor: Kevin Boyle, Park City, UT (US)

(73) Assignee: Alf Wear, Salt Lake City, UT (US)

( * ) Notice: Subject to any disclaimer, the term of this patent is extended or adjusted under 35 U.S.C. 154(b) by 157 days.

(21) Appl. No.: 14/932,422

(22) Filed: Nov. 4, 2015

(65) Prior Publication Data

US 2017/0119065 A1 May 4, 2017

(51) Int. Cl.
*A41D 27/00* (2006.01)
*A41D 27/20* (2006.01)
*A41D 1/06* (2006.01)

(52) U.S. Cl.
CPC ..... *A41D 27/204* (2013.01); *A41D 1/06* (2013.01); *A41D 27/20* (2013.01); *A41D 27/208* (2013.01)

(58) Field of Classification Search
CPC ..... A41D 1/06; A41D 27/20–27/208
See application file for complete search history.

(56) References Cited

U.S. PATENT DOCUMENTS 1,316,526 A * 9/1919 Weiss ..... A41D 27/20 2/247
2,524,879 A * 10/1950 Capuano ..... A41D 27/20 2/247
3,435,462 A * 4/1969 William ..... A41D 1/06 2/227
3,823,420 A * 7/1974 Breier ..... A41D 27/20 2/247
4,156,295 A * 5/1979 LeRoy ..... A41D 27/20 2/252
D260,321 S 8/1981 Heinfling
D261,320 S 10/1981 Heinfling
D261,322 S 10/1981 Heinfling
D261,445 S 10/1981 Heinfling
D278,375 S 4/1985 Heinfling
D278,377 S 4/1985 Heinfling
D278,379 S 4/1985 Heinfling
5,794,267 A * 8/1998 Wallace ..... A41D 27/08 2/115
D528,742 S 9/2006 Langmantel
D541,507 S 5/2007 Lee et al.
D582,633 S 12/2008 Zhang
(Continued)

OTHER PUBLICATIONS

Office Action dated Jun. 30, 2016 in Design U.S. Appl. No. 29/544,560.

(Continued)

*Primary Examiner* — Khaled Annis
(74) *Attorney, Agent, or Firm* — Venable LLP; Steven J. Schwarz; Kerri M. Patterson

(57) ABSTRACT

Pants can include a waist portion; first and second legs extending from the waist portion; and at least one rear pocket located in the waist portion and surrounded by pants fabric, the at least one rear pocket including an interior panel attached to an inner surface of the pants fabric and an exterior panel attached to an outer surface of the interior panel, and material of the interior and exterior panels being discontinuous with the pants fabric, wherein at least a portion of an outer surface of the exterior panel is flush with an outer surface of the pants fabric.

20 Claims, 9 Drawing Sheets

(56) References Cited

U.S. PATENT DOCUMENTS

| | | | | |
|---|---|---|---|---|
| D591,029 | S | 4/2009 | Zhang | |
| D619,334 | S | 7/2010 | Barina | |
| D625,902 | S | 10/2010 | Karpe | |
| D668,433 | S | 10/2012 | Boyle | |
| D693,993 | S | 11/2013 | Karpe | |
| D731,154 | S | 6/2015 | Shaw | |
| 2004/0133966 | A1* | 7/2004 | Ebihara | A41D 27/207 2/247 |
| 2007/0107111 | A1* | 5/2007 | Passman | A41D 13/0012 2/247 |
| 2007/0180596 | A1* | 8/2007 | Shelton | A41D 27/207 2/113 |
| 2013/0125287 | A1 | 5/2013 | Boyle | |
| 2015/0040281 | A1* | 2/2015 | Gbadamosi | A41D 27/201 2/69 |
| 2015/0313302 | A1 | 11/2015 | Boyle | |
| 2016/0071441 | A1* | 3/2016 | Passman | G09F 3/207 2/69 |
| 2016/0120246 | A1* | 5/2016 | Boyle | A41D 31/0005 2/227 |

OTHER PUBLICATIONS

Back Pocket Style 836, posted at makeyourownjeans.com, earliest date available Feb. 24, 2015, [online], acquired on Jun. 16, 2016. Available from Internet, <URL: http://makeyourownjeans.com/add-ons/pocket-styles/back-pocket-style-836>.

Skinny High Waist Jeans, posted at seamstresserin.com, earliest date available Oct. 29, 2012, [online], acquired on Jun. 16, 2016. Available from Internet, <URL: http://seamstresserin.com/skinny-high-waist-jeans-2/>.

* cited by examiner

REAR POCKET FOR PANTS, PANTS INCLUDING SAME, AND RELATED METHODS

TECHNICAL FIELD

This patent application relates generally to clothing, such as pants, shorts, and the like. More specifically, the present application relates to a rear pocket for pants that can lie flush with surrounding regions of the pants to optimize appearance, durability, fit, and comfort.

BACKGROUND

Clothing for people with an active lifestyle has existed for a number of years. Such clothing is typically used during recreational activities such as hiking, climbing, skiing, and other outdoor activities. Additionally, recreational clothing is often worn for everyday life activities, such as at home or in the office. Examples of recreational clothing include pants and shorts, as well as shirts, jackets, and other types of outerwear. Pants have encountered challenges associated with current rear pocket designs and methods of manufacturing.

SUMMARY

Pants can include a waist portion; first and second legs extending from the waist portion; and at least one rear pocket located in the waist portion and surrounded by pants fabric, the at least one rear pocket including an interior panel attached to an inner surface of the pants fabric and an exterior panel attached to an outer surface of the interior panel, and material of the interior and exterior panels being discontinuous with the pants fabric, wherein at least a portion of an outer surface of the exterior panel is flush with an outer surface of the pants fabric.

A method of manufacturing pants can include forming a waist portion and first and second legs extending from the waist portion; forming at least one rear pocket opening in pants fabric in the waist portion; connecting an interior panel, which is larger than the rear pocket opening, to an inner surface of the pants fabric; and connecting an exterior panel, which is the same size or smaller than the rear pocket opening, with the interior panel, wherein the connecting of the exterior panel defines a pocket pouch having an open top edge, wherein at least a portion of an outer surface of the exterior panel is flush with an outer surface of the pants fabric.

A fabric pocket can include a fabric material; and at least one pocket surrounded by the fabric material, the at least one pocket including an interior panel attached to an inner surface of the fabric material and an exterior panel attached to an outer surface of the interior panel, and material of the interior and exterior panels being discontinuous with the fabric material, wherein at least a portion of an outer surface of the exterior panel is flush with an outer surface of the fabric material.

Additional features, advantages, and embodiments of the invention are set forth or apparent from consideration of the following detailed description, drawings and claims. Moreover, it is to be understood that both the foregoing summary of the invention and the following detailed description are examples and intended to provide further explanation without limiting the scope of the invention as claimed.

BRIEF DESCRIPTION OF THE DRAWINGS

The foregoing and other features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Various embodiments of the invention are discussed in detail below. While specific embodiments are discussed, it should be understood that this is done for illustration purposes only. A person skilled in the relevant art will recognize that other components and configurations can be used without departing from the spirit and scope of the invention.

As used herein, terms such as "front," "back," "rear," "left," "right," "upper," and "lower" are used to describe positions relative to one another only and not to denote an absolute position. For example, an "upper portion" can become a "left," "right," or "lower" portion by rotating the item, although it can still be referred to as an "upper" portion of the item. As used herein, the term "flush" can mean substantially level or even with another surface.

Embodiments can provide pants and shorts (referred to collectively herein as "pants," unless otherwise specified) that comprise durable and stretchy materials to provide appearance, comfort, fit, and durability. For example, embodiments of the pants can include relatively stretch-resistant materials, such as woven fabrics, to provide durability and structure, as well as relatively stretchy materials, such as knitted fabrics, for fit and maneuverability. Additionally, as described below, embodiments of the pants can include a rear pocket that lies flush with at least some of the surrounding regions of the pants, instead of resting on top of the surrounding material. For example, the rear pocket can include an exterior panel that is fastened to an interior panel/pocket to provide a flush rear pocket. According to embodiments, this can provide pants having a rear pocket similar to a "chino" style pant, while simultaneously including subtle decorative patterns similar to the rear pocket of a "jean" style pant.

Figure 1:
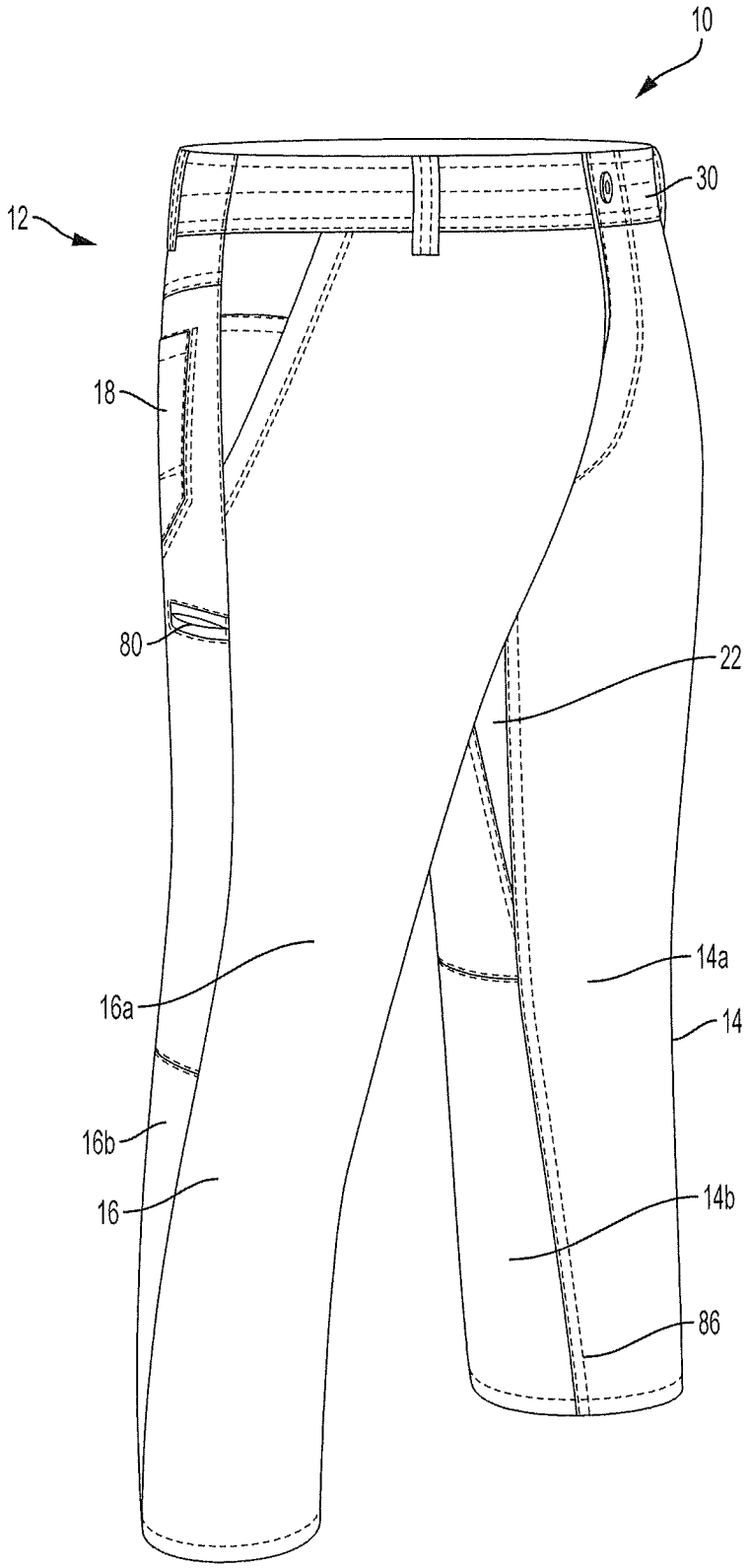
FIG. 1 is a front-right perspective view of pants, according to an embodiment of the present invention.
Figure 2:
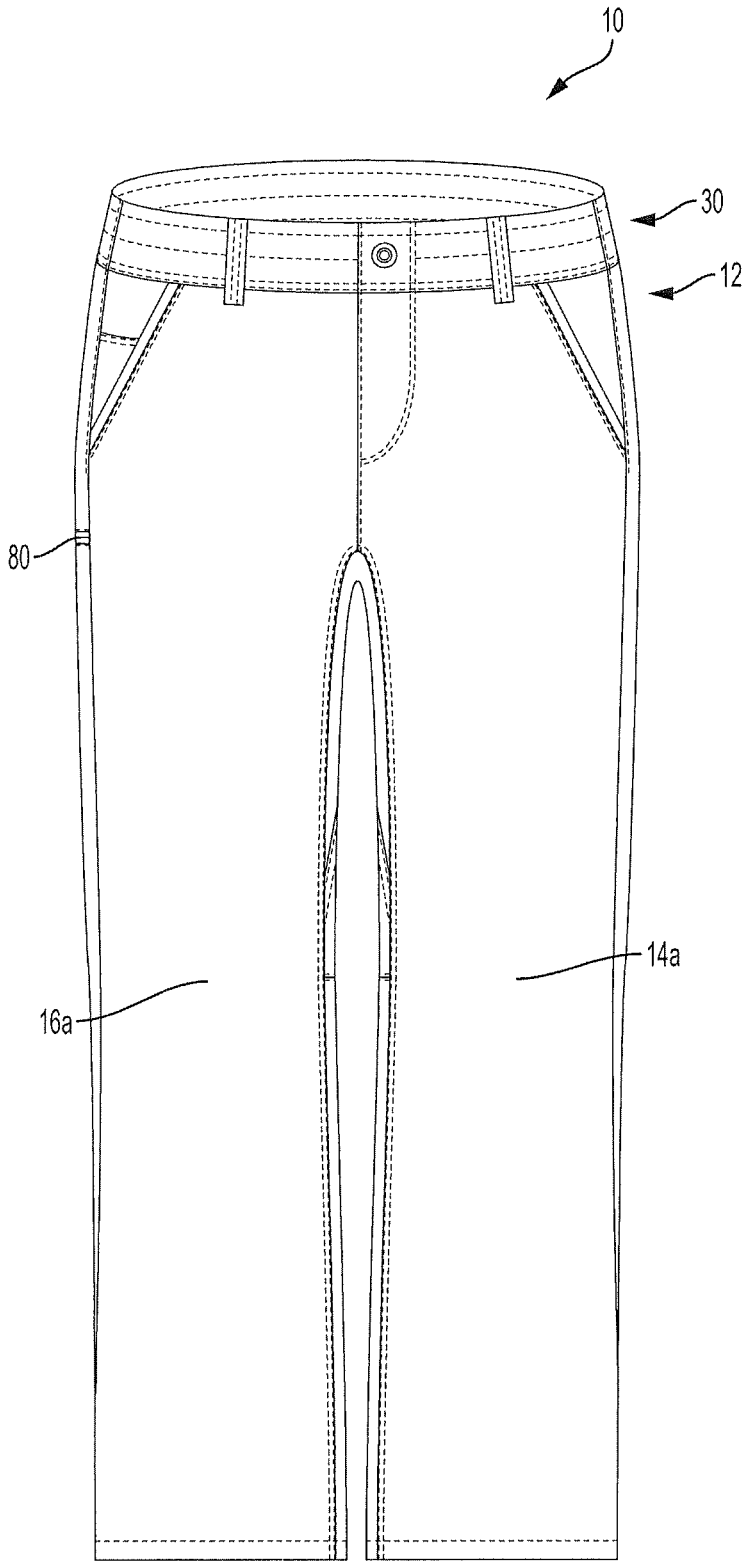
FIG. 2 is a front view of the pants of FIG. 1.
Figure 3:
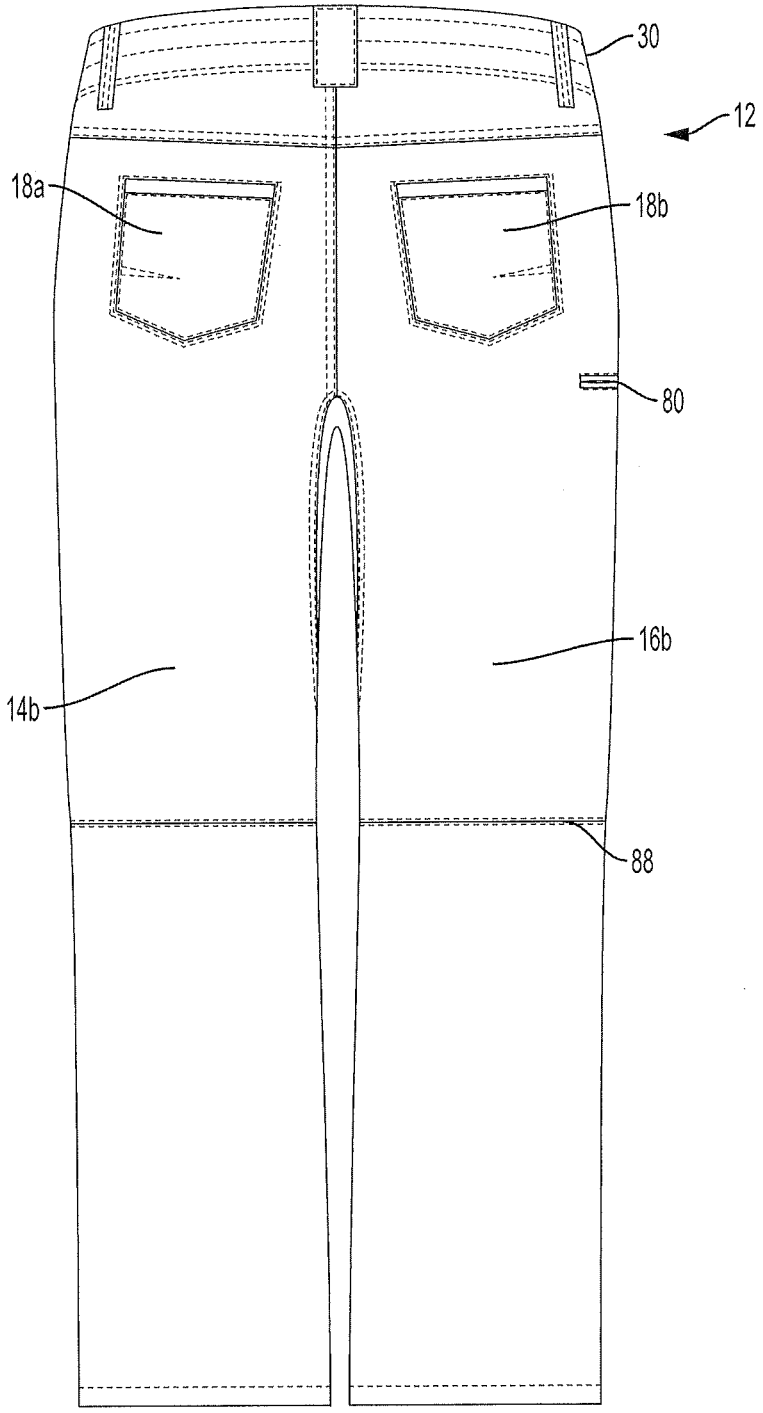
FIG. 3 is a rear view of the pants of FIG. 1.
Figure 4:
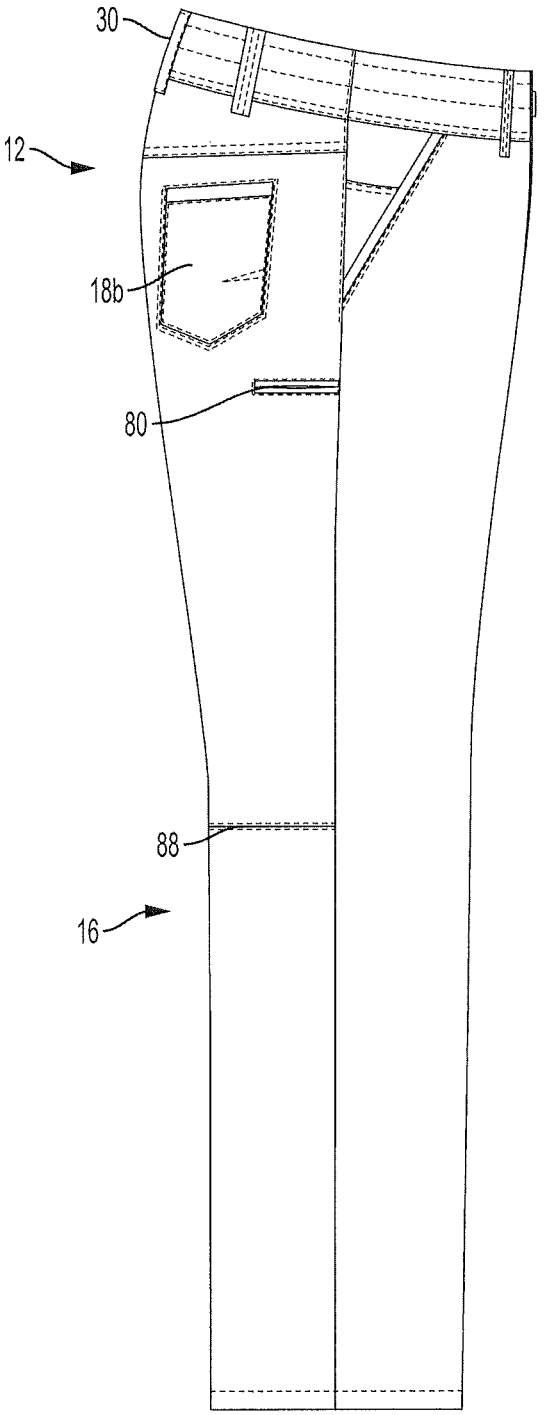
FIG. 4 is a right side view of the pants of FIG. 1.

Referring to FIG. 1, the pants 10 can generally include a waist portion 12 that fits around the wearer's waist and crotch. The waist portion 12 of pants 10 can include a waist band 30. The pants 10 can also include first and second legs 14, 16, such as right and left legs. The legs 14, 16 can each include a front panel 14*a*, 16*a*, and a rear panel 14*b*, 16*b*, respectively, each of which can be formed at least partially of a woven or knit fabric. Respective front panels 14*a*, 16*a* and rear panels 14*b*, 16*b* can be joined by a seam 86 (e.g., a row of stitching) extending along the inner leg and thigh region of the legs 14, 16. According to embodiments, the seam 86 can extend continuously from the first leg 14 to the second leg 16, across the crotch region, and can border a portion of a crotch gusset 22, however, other embodiments are possible. As shown in FIGS. 3 and 4, a horizontal seam 88 (e.g., a row of stitching) can bisect the rear panels 14*b*, 16*b* of the first and second legs 14, 16.

As shown in FIGS. 1-5, the first and second legs 14, 16 can be long-legs that extend over substantially all of a wearer's legs (e.g., to their feet or ankles), or alternatively, short-legs that cover only a portion of the wearer's legs (e.g., extend to the knee). Alternatively, pants 10 can have leg lengths somewhere between long-legs and short-legs, for example, as may be the case with "knickers."

Figure 5:
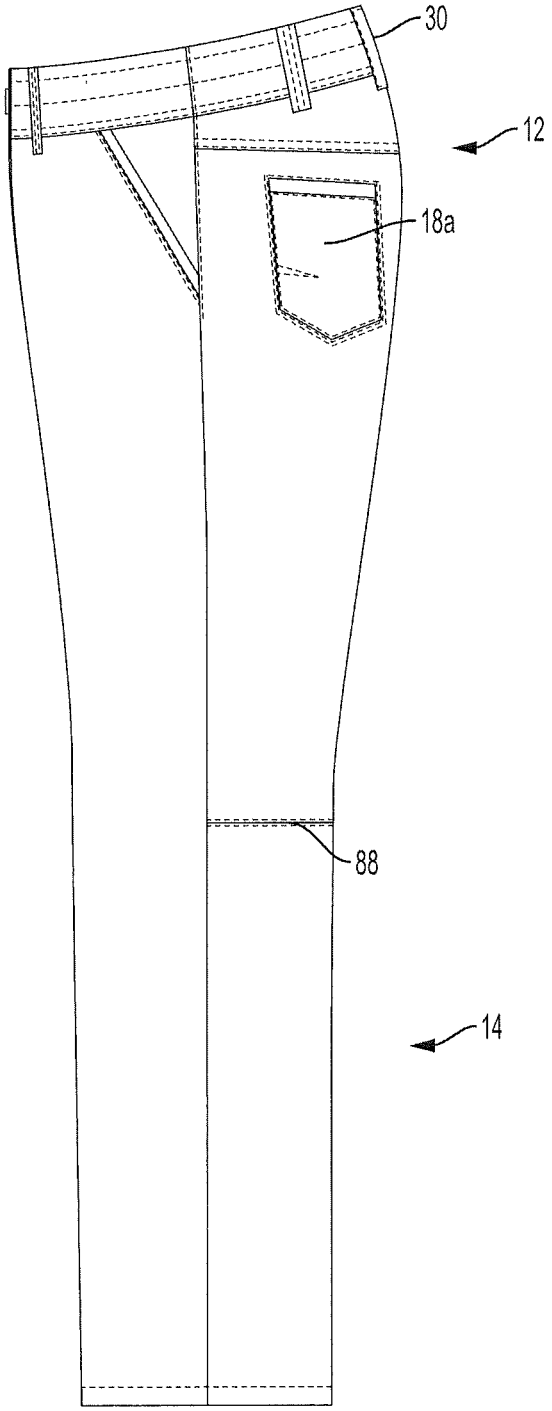
FIG. 5 is a left side view of the pants of FIG. 1.

Referring to FIGS. 4 and 5, an embodiment shows that at least one rear pocket 18*a* or 18*b* can be located below the waist band 30. Embodiments of the rear pocket are described in more detail in FIGS. 6-10. The construction of the rear pocket 18*b* in FIG. 4 can be the same or substantially the same as the rear pocket 18*a* of FIG. 5.

Figure 6:
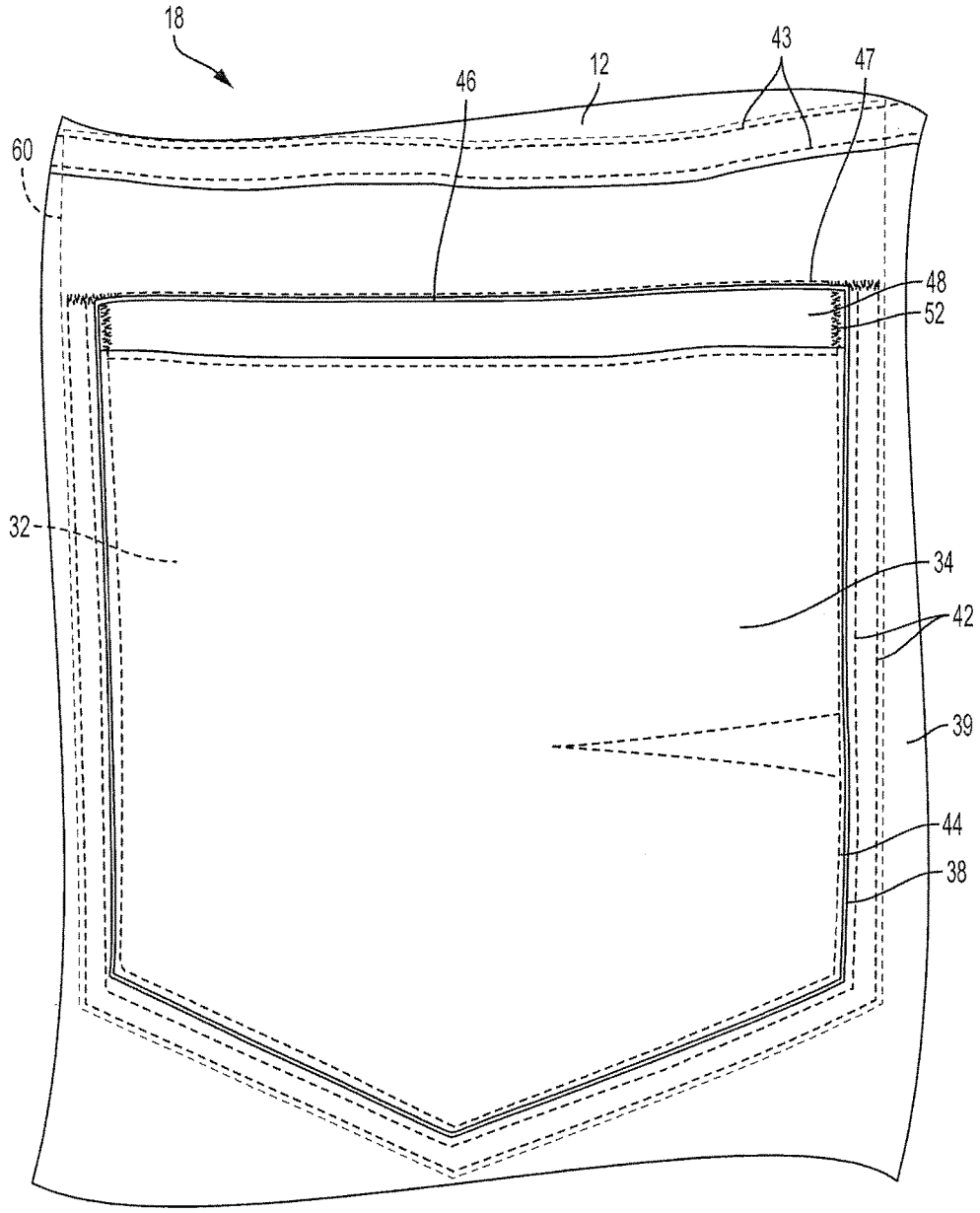
FIG. 6 is an enlarged view of a rear pocket of the pants of FIG. 1, according to an embodiment of the present invention.
Figure 7:
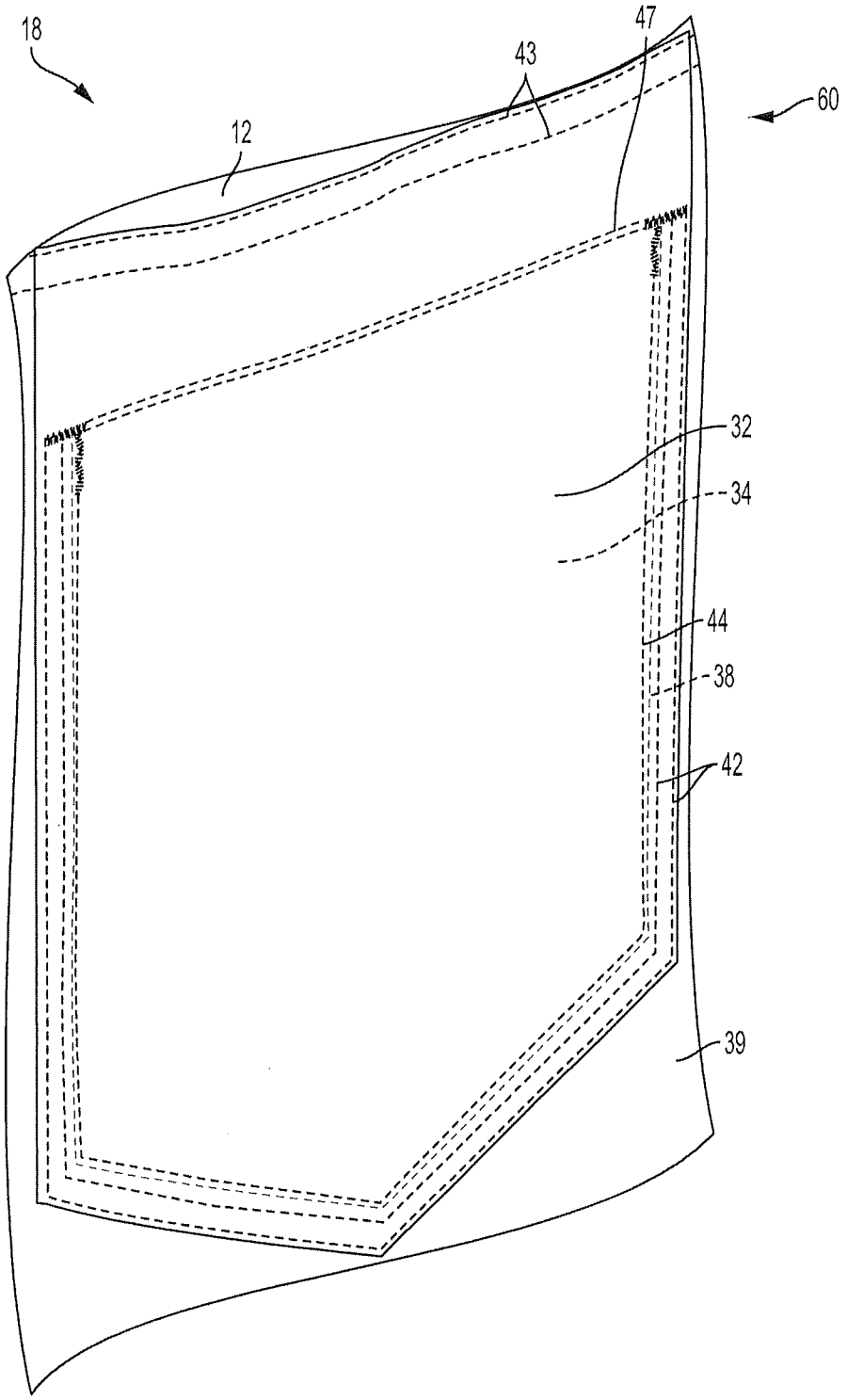
FIG. 7 is an enlarged, perspective view of the rear pocket of FIG. 6, shown from inside the pants, according to an embodiment.

Referring to FIG. 6, the at least one rear pocket 18 can include an interior panel 32 and an exterior panel 34. The interior panel 32 is located beneath the exterior panel 34, and hence, hidden from view in FIG. 6. Material of the interior and exterior panels 32, 34 can be discontinuous with the pants fabric 39. For example, as shown in FIG. 6, the discontinuity between the pants fabric 39 and the exterior panel 34 results in a small gap 38 or seam between the pants fabric 39 and the exterior panel 34. This discontinuity can result in the exterior panel 34 comprising an area 62 (shown in FIG. 11) that is smaller than an opening formed in the pants fabric. That is, the discontinuity can be formed, for example, by forming an opening of the pants fabric and connecting the interior panel 32 to the pants fabric from an interior of the pants. This can create a slight indentation. Then the exterior panel, which can be shaped to be slightly smaller than the removed section of the pants fabric, can be connected to the interior panel 32 to fill in the indentation. Because the exterior panel is slightly smaller than the area of the removed section, or the hole formed in the pants fabric, the gap 38 or seam can run along the exterior panel. In an embodiment, the gap 38 runs around an entirety of the exterior panel 34.

As shown in FIG. 6, a connector mechanism, described in more detail below, can connect the interior panel 32 and the exterior panel 34 to the pants fabric 39 surrounding the pocket 18. The connector mechanism between the panels 32, 34 can comprise stitching, bonding, ultrasonic welding, or another mechanism known in the art that is suitable to join two or more fabrics.

As seen from FIG. 6, the stitching can comprise an outer set of threading 42 that directly connects the pants fabric to the interior panel 32, for example, with the interior panel 32 located inside the pants fabric 39. The outer set of threading 42 can circumscribe the exterior panel 34. As can be seen from FIG. 6, the outer set of threading 42 can include two lines of threading that border or circumscribe the removed section or opening formed in the pants fabric and/or sides of the exterior panel 34. For example, as shown in FIG. 6 four sides are bordered by two lines of threading. However, a single line of threading is also contemplated within the scope of an embodiment of the invention. For example, FIG. 6 shows that a top side of the external panel 34 is bordered by a single line of threading 47. In addition to serving to connect the interior panel 32 with the pants fabric 39, the outer set of threading 42 can also serve to fold edges of the removed section in on itself so that the resulting edges of the removed section are smooth and durable. This smoothened edge can allow for a smooth alignment of the exterior panel 34 having a relatively uniform gap between the edges of the exterior panel 34 and the opening's edges.

Still referring to FIG. 6, the interior panel 32 of the at least one rear pocket 18 can be connected to an inner surface region 60 of the pants fabric 39. In an embodiment, the interior panel 32 can extend inwardly in relation to the pants fabric 39. In other words, the interior panel 32 can define a perimeter that is larger than the perimeter of the opening in pants fabric 39 as shown by dashed line 60 in FIG. 6.

While FIG. 6 shows that the outer set of threading includes lines of threading circumscribing the edge or near the edge of the external panel 34, it is also contemplated within the scope of an embodiment of the invention that the outer set of threading 42 can include lines of threading a distance away from the external panel 34, so long as the interior panel 32 can be secured to the pants. For example, FIG. 6 shows two lines of threading 43 running a distance removed from, and above, external panel 34, where the two lines of threading 43 can attach the upper edge of the interior panel 32 to the pants fabric 39, e.g., at or below the waist band 30 (labeled in FIG. 1).

The stitching can further comprise an inner set of threading 44 that directly connects the exterior panel 34 with the interior panel 32. The inner set of threading 44 can run along an edge or near an edge of each side of the exterior panel 34 except for a top side 46 of the exterior panel 34, thus providing an upper opening for the pocket 18.

As shown in FIG. 3, the at least one rear pocket can comprise a left rear pocket 18*a* over a left leg and a right rear pocket 18*b* over a right leg. In an embodiment, the first and second rear pockets 18*a*, 18*b* can be shaped in a traditional five-vertex pocket shape. In some embodiments, the rear pockets 18*a*, 18*b* can be shaped like an upside down pentagon; that is, a pentagon with the base upwards and the vertex downwards. The pentagon base can coincide with the pocket opening, while the two opposite sides of the pentagon can coincide with the pockets sides, and the two base sides of the pentagon (the ones forming a "V") coincide with the pocket bottom. Thus, the at least one rear pocket can be shaped in a traditional upside-down pentagon shape. In other embodiments, the left and right rear pockets 18*a*, 18*b* can have a shape with fewer or more than five vertexes, for example, square or rectangular or even irregular shapes.

Referring back to FIG. 6, the rear pocket 18 can comprise a lip 48 on an upper edge 46 of the exterior panel 34. The lip 48 can include fabric of the exterior panel 34 to be folded down on itself either inwardly facing the interior panel of the pants or outwardly facing. Alternatively, the lip 48 can be separate fabric from the exterior panel 34 to be attached to the external panel. By folding the lip fabric down on itself, the lip 48 can thus have a smooth and durable edge that can facilitate a long-lasting design for the pocket. The lip 48 can have a reinforced stitch 52 for increased durability and strength of the pocket.

As shown in FIGS. 1-5, the pants can further comprise a cell phone pocket 80 formed of the pants fabric on an outer surface of a side of one of the legs. The cell phone pocket 80 can define an opening at a top region of the cell phone pocket and can extend downward. The cell phone pocket 80 can be in a substantially rectangular shape. An outer surface of the cell phone pocket 80 can have stitching that circumscribes only one side of the cell phone pocket. The cell phone pocket 80 can be formed such that a side of the pocket extending downward shares a border with a seam in the pants fabric.

Details of construction of the rear pocket 18 are described in more detail in FIGS. 8-11. The at least one rear pocket 18 can include an interior panel 32, shown in FIG. 10 (and also FIG. 7), and an exterior panel 34, shown in FIGS. 8 and 9. Material of the interior and exterior panels 32, 34 can be discontinuous with the pants fabric 39. For example, as shown in FIG. 6, the discontinuity between the pants fabric and the exterior panel 34 can result in a small gap 38 or seam between the pants fabric 39 and the exterior panel 34.

Figure 10:
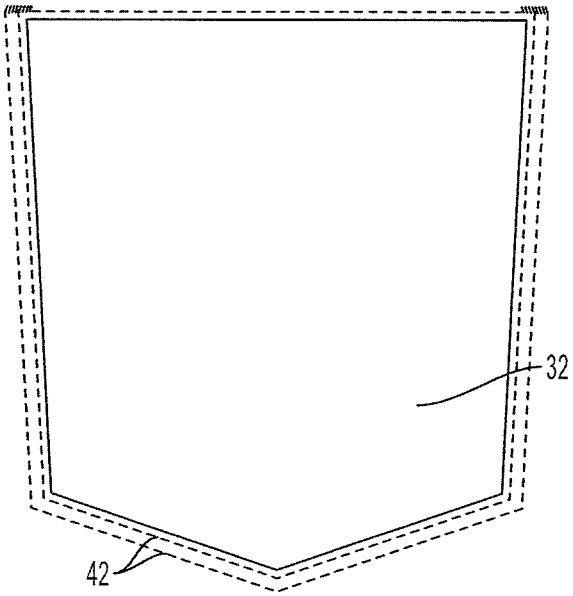
FIG. 10 is a rear-facing view of the interior panel of the rear pocket of FIG. 6, shown with an opening formed in the pants fabric, according to an embodiment of the present invention.
Figure 9:
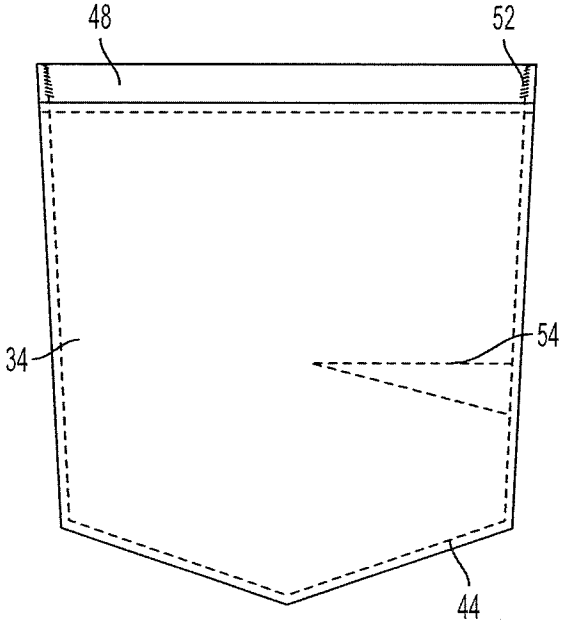
FIG. 9 is a rear-facing view of the exterior panel of the rear pocket of FIG. 6, according to an embodiment of the present invention.
Figure 8:
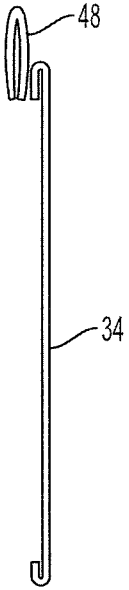
FIG. 8 is a side, cross-sectional view of the exterior panel of the rear pocket of FIG. 6, according to an embodiment of the present invention.
Figure 11:
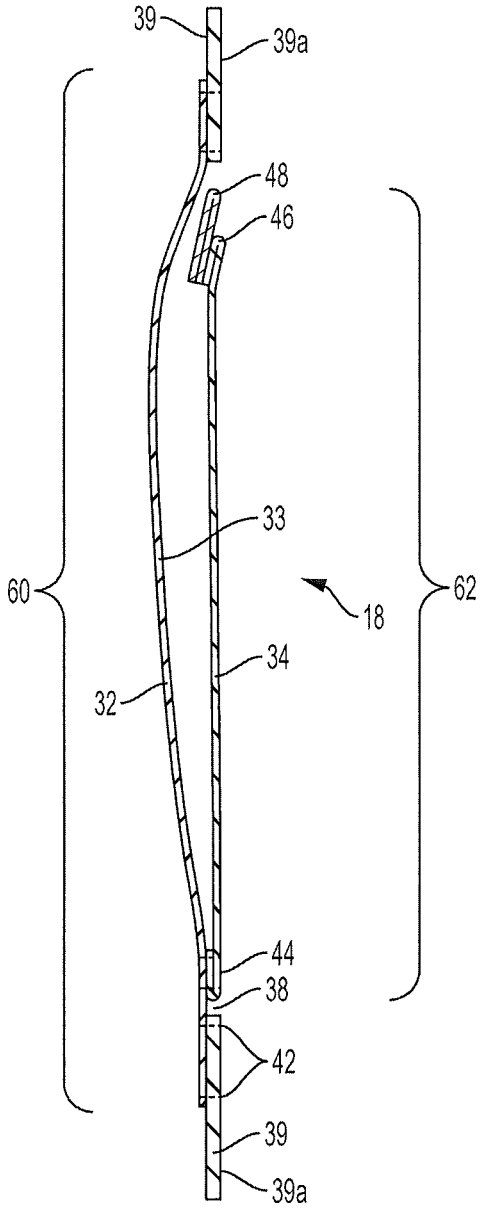
FIG. 11 is a side, cross-sectional view of the rear pocket of FIG. 6, according to an embodiment of the present invention.

FIGS. 8-10 show the exterior panel 34 detached from the interior panel 32. The interior panel 32 can be attached to the inner surface of the pants fabric 39. This can create a slight indent, into which the exterior panel 34 can fit. Thus, as can be seen in FIG. 11, an outer surface of the exterior panel 34 can be substantially flush with all or part of an outer surface of the pants fabric 39. For example, at least some of the side and bottom edges of the exterior panel 34 can be substantially flush with the outer surface of the pants fabric 39. Some of the features and dimensions of FIG. 11 are exaggerated for illustration purposes. In some embodiments, a lip 48 portion is attached to the exterior panel 34 adding a thickness to the exterior panel such that the lip 48 is not necessarily flush with the outer surface of the pants fabric 39. Thus, a substantial portion of the outer surface of the exterior panel 34 can be flush with an outer surface of the pants fabric 39. Further, as discussed above, an outer surface 33 of the interior panel 32 can be inset with respect to the outer surface 39*a* of the pants fabric 39 forming an indent for receipt of the exterior panel 34. In an embodiment, the pants can comprise a lip 48 on an upper region 46 of the exterior panel 34. The lip 48 can be material of the exterior panel that is doubled down on itself in a direction towards the interior of the pants. Alternatively, the lip 48 can be additional material attached to the exterior panel 34. As can be seen from FIG. 11, the exterior panel 34 can comprise the exterior-facing wall of the pocket 18.

FIG. 11 is a side, cross-sectional view depicting how the interior panel 32 of the at least one rear pocket 18 can be connected to an inner surface 60 of the pants fabric 39. In an embodiment, the interior panel 32 can extend inwardly in relation to the pants fabric 39, for example, it can be larger than the opening in the pants fabric 39. In some embodiments, the connected inner surface 60 can be larger than an area 62 of the exterior panel 34.

As seen from FIG. 11, the stitching can comprise an outer set of threading 42 that directly connects the pants fabric 39 to the interior panel 32. The outer set of threading 42 can circumscribe the exterior panel 34. The stitching can comprise an inner set of threading 44 that directly connects the exterior panel 34 with the interior panel 32. The inner set of threading 144 can run along an edge of each side of the exterior panel 34 except for a top side 46 of the exterior panel 34.

While reference has been made to a pocket on a back side of pants, the invention is not limited to such a placement or to such an article of clothing. For example, some of the broad inventive principles disclosed herein include more generally pocket configurations including fabric component pockets. In this embodiment, the fabric component pocket can include a fabric material and at least one pocket in the fabric material. The at least one pocket can include an interior panel 32 and an exterior panel 34. Material of the interior and the exterior panels 32, 34 can be discontinuous with the fabric material. This discontinuity may result in a gap being formed between the exterior panel and the fabric material. The fabric component pocket can also include a connector mechanism that connects the interior panel and the exterior panel to the fabric material. In this embodiment, an outer surface of the exterior panel can be substantially flush with all or a portion of an outer surface of the fabric material, and an outer surface of the interior panel can be inset or not flush with the outer surface of the fabric material.

FIGS. 8-11 show elements that can be involved in a method of manufacturing a rear pocket for pants. In an embodiment, the pants can have an approximately pocket-sized opening located below the waist band. In an embodiment, the opening can be made before the pants are formed, or alternatively, after the pants are formed. For example, at least one opening can be made in the rear panels 14*b* and/or 16*b* before being joined by a seam 86 (e.g., a row of stitching) extending along the inner leg and thigh region of the legs 14, 16. Alternatively, at least one opening can be made in the waist portion after the rear panels are joined by the seam.

FIG. 8 shows a side profile of an exterior panel 34, which can be connected to the interior panel 32, and which can in turn be connected to the pants fabric 39 on an inner surface of the pants fabric. The construction is not limited to the sequence described above. As shown, the exterior panel 34 can include a lip 48 at a top end. The connecting of the exterior panel can connect all sides of the exterior panel 34 to the interior panel 32 except for a top side 46 of the exterior panel 34. In other words, the connecting can include directly connecting, for example through stitching, the inner surface of the exterior panel 34 with the outer surface of the interior panel 32 along bottom and side edges of the exterior panel 34.

In an embodiment, the top side of the exterior panel 34 can connect to the lip 48, which can be attached on an interior-facing side of the exterior panel 34. The lip 48 can include fabric of the exterior panel 34 to be folded down on itself either inwardly facing the interior panel 32 of the pants or outwardly facing. Alternatively, the lip 48 can be separate fabric from the exterior panel 34 to be attached to the external panel. By folding the lip fabric down on itself, the lip 48 can thus have a smooth and durable edge that can facilitate a long-lasting design for the pocket. The lip 48 can have a reinforced stitch 52 for increased durability and strength of the pocket. In this embodiment, an outer surface of the exterior panel 34 can be substantially flush with an outer surface of the pants fabric 39. In some embodiments, the outer surface of the exterior panel 34 that is substantially flush with the outer surface of the pants fabric 39 is a substantial portion of the exterior panel 34. Further, an outer surface of the interior panel 32 can be inset with respect to the outer surface of the pants fabric 39. The exterior panel 34 can have a triangular-shaped stitching 54 that extends from an edge of the exterior panel 34 to a mid-point region of the exterior panel 34. As shown in FIG. 9, the triangular-shaped stitching 54 can be a right triangle with an adjacent side running along the pocket side, the opposite side of the triangular shape running to the mid-point of the exterior panel 34, and the hypotenuse extending from the height of the triangular shape to the adjacent side.

In some embodiments, and referring to FIG. 11, the interior panel 32 of the at least one rear pocket 18 can be connected to an inner surface of the pants fabric 39 and can extend inwardly in relation to the pants fabric (i.e., it is larger than the opening in the pants fabric). The connecting steps can use stitching comprising an outer set of threading 42 that directly connects the pants fabric 39 to the interior panel 32. The outer set of threading 42 can circumscribe the exterior panel 34. The stitching can comprise an inner set of threading 44 that can directly connect the exterior panel 34 with the interior panel 32. The inner set of threading 44 can run along an edge of each side of the exterior panel 34 except for a top side 46 of the exterior panel 34.

According to embodiments, all or parts of pants 10 can be constructed from man-made and/or natural fiber fabrics, such as cotton, cotton/nylon blends, cotton/spandex blends, nylon/spandex blends, polyester, and polyester blends. According to embodiments, knitted materials can be used, such as an 87% nylon/13% spandex blend, however, polyester/spandex, or cotton/spandex blends, and other fabrics known in the art, can alternatively be used. According to embodiments, woven materials can be used, such as about a 68% cotton, 29 percent nylon and 3% spandex blend. However, according to embodiments, a polyester/spandex blend, a cotton/spandex blend, or polyester, or nylon, or other fabrics known in the art, can be used.

In the foregoing description, reference is made to "stitching" various parts of pants 10 together. However, one of ordinary skill in the art will understand, based on this disclosure, that other construction techniques can alternatively be used, for example, without limitation, bonding, ultrasonic welding, or other technique known in the art.

While various embodiments of the present invention have been described above, it should be understood that they have been presented by way of example only, and not limitation. Thus, the breadth and scope of the present invention should not be limited by any of the above-described embodiments, but should instead be defined only in accordance with the following claims and their equivalents.

What is claimed is:

1. Pants constructed from at least one pants fabric, comprising:

a waist portion containing an opening in the pants fabrics;

first and second legs extending from the waist portion; and at least one rear pocket located in the waist portion, the at least one rear pocket including an interior panel attached to an inner surface of the pants fabric, and an exterior panel inset in the opening in the pants fabric and attached to an outer surface of the interior panel, the interior panel and the exterior panel being discontinuous with the pants fabric, wherein a portion of an outer surface of the exterior panel adjacent to the opening in the pants fabric is completely flush with an outer surface of the pants fabric.

2. The pants of claim 1, wherein the interior panel of the at least one rear pocket is connected to the inner surface of the pants fabric, the interior panel defines the opening with respect to the pants fabric, and the exterior panel fits within the opening.

3. The pants of claim 1, wherein the interior panel of the rear pocket is larger than the exterior panel of the rear pocket.

4. The pants of claim 1, wherein the interior panel is attached to the inner surface of the pants fabric by stitching, and the exterior panel is attached to the outer surface of the interior panel by stitching.

5. The pants of claim 4, wherein the stitching comprises an outer set of threading that directly connects the interior panel to the inner surface of the pants fabric, the outer set of threading circumscribing the exterior panel.

6. The pants of claim 5, wherein the stitching further comprises an inner set of threading that directly connects an inner surface of the exterior panel with the outer surface of the interior panel, the inner set of threading running along bottom and side edges of the exterior panel.

7. The pants of claim 1, wherein the at least one rear pocket comprises a first rear pocket over the first leg and a second pocket over the second leg.

8. The pants of claim 1, wherein the interior panel and the exterior panel comprise an upside-down pentagon shape.

9. The pants of claim 1, further comprising a lip located on an upper edge of the exterior panel.

10. The pants of claim 9, wherein the lip comprises a discrete piece from the exterior panel, the lip being attached to the inner surface of the exterior panel, wherein the lip comprises two edges at one end and a folded edge at an opposing end, the two edges being attached to the exterior panel.

11. A method of manufacturing pants, comprising:

forming a waist portion and first and second legs extending from the waist portion;

forming at least one rear pocket opening in pants fabric in the waist portion;

connecting an interior panel, which is larger than the rear pocket opening, to an inner surface of the pants fabric; and insetting an exterior panel, which is the same size or smaller than the rear pocket opening, in the rear pocket opening;

connecting the exterior panel with the interior panel, wherein the connecting of the exterior panel defines a pocket pouch having an open top edge, wherein a portion of an outer surface of the exterior panel adjacent to the opening in the pants fabric is completely flush with an outer surface of the pants fabric.

12. The method of claim 11, wherein the interior panel of the at least one rear pocket is connected to the inner surface of the pants fabric.

13. The method of claim 11, wherein connecting the interior panel to the inner surface of the pants fabric comprises stitching an outer set of threading that directly connects the pants fabric to the interior panel, the outer set of threading circumscribing the exterior panel.

14. The method of claim 13, wherein connecting the exterior panel to the interior panel comprises stitching an inner set of threading that directly connects the exterior panel with the interior panel, the inner set of threading running along bottom and side edges of the exterior panel.

15. A garment pocket, comprising;

a fabric containing an opening; and at least one pocket, the at least one pocket including an interior panel attached to an inner surface of the fabric and an exterior panel inset in the opening in the fabric and attached to an outer surface of the interior panel, and the interior panel and the exterior panel being discontinuous with the fabric, wherein a portion of an outer surface of the exterior panel adjacent to the opening in the fabric is completely flush with an outer surface of the fabric.

16. The garment pocket of claim 15, wherein the interior panel of the at least one pocket is connected to the inner surface of the fabric.

17. The garment pocket of claim 15, wherein the interior panel of the pocket is larger than the exterior panel of the pocket.

18. The garment pocket of claim 15, wherein the interior panel is attached to the inner surface of the fabric by stitching, and the exterior panel is attached to the outer surface of the interior panel by stitching.

19. The garment pocket of claim 18, wherein the stitching comprises an outer set of threading that directly connects the interior panel to the inner surface of the fabric, the outer set of threading circumscribing the exterior panel.

20. The garment pocket of claim 19, wherein the stitching further comprises an inner set of threading that directly connects an inner surface of the exterior panel with the outer surface of the interior panel, the inner set of threading running along bottom and side edges of the exterior panel.

* * * * *